US008961123B2

(12) United States Patent
Tseng et al.

(10) Patent No.: US 8,961,123 B2
(45) Date of Patent: Feb. 24, 2015

(54) CENTRIFUGAL FAN

(75) Inventors: Chun-Fa Tseng, Kaohsiung (TW); Yu-Nien Huang, Taoyuan County (TW); Cheng-Yu Cheng, Taoyuan County (TW); Da-Wei Wu, Taoyuan County (TW)

(73) Assignee: Quanta Computer Inc., Taoyuan Shien (TW)

( * ) Notice: Subject to any disclaimer, the term of this patent is extended or adjusted under 35 U.S.C. 154(b) by 469 days.

(21) Appl. No.: 13/315,977

(22) Filed: Dec. 9, 2011

(65) Prior Publication Data

US 2013/0039751 A1 Feb. 14, 2013

(30) Foreign Application Priority Data

Aug. 11, 2011 (TW) ..... 100128750 A

(51) Int. Cl.
*F04D 29/66* (2006.01)
*F04D 29/70* (2006.01)

(52) U.S. Cl.
CPC ..... *F04D 29/703* (2013.01); *F04D 29/663* (2013.01)
USPC ..... 415/206

(58) Field of Classification Search
CPC ..... F04D 29/703; F04D 29/663
USPC ..... 415/182.1, 191, 203, 206, 220; 416/247 R; 361/690–697
See application file for complete search history.

(56) References Cited

U.S. PATENT DOCUMENTS 4,761,115 A * 8/1988 Hopfensperger ..... 415/119
5,466,120 A * 11/1995 Takeuchi et al. ..... 415/119
6,139,265 A * 10/2000 Alizadeh ..... 415/208.1
6,386,276 B1 * 5/2002 Chen et al. ..... 165/121
6,579,064 B2 * 6/2003 Hsieh ..... 416/182
6,657,860 B2 * 12/2003 Matsui et al. ..... 361/695
6,663,342 B2 * 12/2003 Huang et al. ..... 415/121.2
7,014,420 B2 * 3/2006 Chang ..... 415/121.2
7,391,611 B2 * 6/2008 Ko et al. ..... 361/695
7,492,588 B2 * 2/2009 Hwang et al. ..... 361/694
7,500,826 B2 * 3/2009 Tseng et al. ..... 415/206
7,679,907 B2 * 3/2010 Kaneko ..... 361/695
7,780,404 B2 * 8/2010 Horng et al. ..... 415/191
8,075,257 B2 * 12/2011 Tien et al. ..... 415/185
8,206,099 B2 * 6/2012 Tsai et al. ..... 415/206
8,256,495 B2 * 9/2012 Hattori et al. ..... 165/11.1
8,267,158 B2 * 9/2012 Zha et al. ..... 165/80.3
8,313,284 B2 * 11/2012 Hirata ..... 415/119
8,562,291 B2 * 10/2013 Tan ..... 415/178

(Continued)

FOREIGN PATENT DOCUMENTS

CN 2206849 Y 9/1995
CN 2489125 Y 5/2002

(Continued)

*Primary Examiner* — Nathaniel Wiehe
*Assistant Examiner* — Eldon Brockman
(74) *Attorney, Agent, or Firm* — Rabin & Berdo, P.C.

(57) ABSTRACT

A centrifugal fan is provided. The centrifugal fan includes a housing, a driving device, and blades. The housing includes a circular base and at least two struts. Each of the struts physically connects the circular base and the remainder of the housing, and each of the struts includes two peripheral edges. The driving device is placed on the circular base. Each of the blades has an arc shape and the blades are located in the housing. The driving device rotates the blades. The two peripheral edges of each of the struts form orthogonal curves with the blades.

10 Claims, 3 Drawing Sheets

(56) References Cited

U.S. PATENT DOCUMENTS

| | | | | |
|---|---|---|---|---|
| 2003/0017048 | A1* | 1/2003 | Lin | 415/206 |
| 2003/0026691 | A1* | 2/2003 | Huang et al. | 415/121.2 |
| 2004/0033135 | A1* | 2/2004 | Chang | 415/220 |
| 2006/0045737 | A1* | 3/2006 | Wung et al. | 415/220 |
| 2007/0251677 | A1* | 11/2007 | Hwang et al. | 165/122 |
| 2008/0019827 | A1* | 1/2008 | Hirata | 415/206 |
| 2008/0087407 | A1* | 4/2008 | Yang | 165/104.33 |
| 2008/0105410 | A1* | 5/2008 | Hwang et al. | 165/104.33 |
| 2008/0152479 | A1* | 6/2008 | Horng et al. | 415/119 |
| 2008/0180913 | A1 | 7/2008 | Kaneko | |
| 2009/0129921 | A1* | 5/2009 | Hwang et al. | 415/206 |
| 2009/0169373 | A1* | 7/2009 | Hwang et al. | 415/206 |
| 2009/0185349 | A1* | 7/2009 | Hata | 361/697 |
| 2009/0290307 | A1* | 11/2009 | Hwang et al. | 361/695 |
| 2009/0324403 | A1* | 12/2009 | Zheng | 415/203 |
| 2010/0025022 | A1* | 2/2010 | Tien et al. | 165/121 |
| 2010/0071875 | A1* | 3/2010 | Hwang et al. | 165/80.3 |
| 2012/0288384 | A1* | 11/2012 | Chou et al. | 417/410.1 |
| 2013/0115066 | A1* | 5/2013 | Lin et al. | 415/182.1 |

FOREIGN PATENT DOCUMENTS

| | | |
|---|---|---|
| CN | 101074683 A | 11/2007 |
| TW | 200741107 | 11/2007 |

* cited by examiner

CENTRIFUGAL FAN

RELATED APPLICATIONS

This application claims priority to Taiwan Application Serial Number 100128750, filed Aug. 11, 2011, which is herein incorporated by reference.

BACKGROUND

1. Technical Field

The present disclosure relates to a centrifugal fan.

2. Description of Related Art

Electric apparatuses, such as notebook computers, generate heat when operating. If the heat is not dissipated efficiently, the electric apparatuses may malfunction. In serious situations, the heat may damage electric elements in the electric apparatuses. Furthermore, burning electric elements may hurt users. One method for reducing the heat in electric apparatuses involves the use of centrifugal fans therein. Each centrifugal fan may include blades and a driving device. Heat generated by operation of the electric elements may be dissipated by airflow generated by the centrifugal fans.

In recent years, due to the increased efficiency and increased working temperature of electronic chips, the driving devices of centrifugal fans need to have increased rotating speed to enhance airflow. However, with increased rotating speed, the centrifugal fans may generate increased noise, which may disturb users.

FIG. 1 is a top view of a conventional centrifugal fan 100. As show in FIG. 1, the conventional centrifugal fan 100 includes a housing 110, a driving device 130, and blades 120. The housing 100 includes a base 112 and struts 114. Because each of the struts 114 connected between the base 112 and the remainder of the housing 110 are not designed in any particular manner, the peripheral edges of each of the struts 114 are formed as two substantially parallel straight lines. When the driving device 130 rotates the blades 120 in a direction 140, air is drawn into hollow regions 116 located between the struts 114 and exhausted from an air outlet 118 of the housing 110. At this time, some of the air collides with the struts 114 and generates loud narrowband noise.

Some manufacturers may use materials to decrease the noise generated by the conventional centrifugal fan. For example, some manufacturers may increase the thickness of an external case of an electric apparatus that includes the conventional centrifugal fan in the external case. Moreover, sound-insulation boards or sound-absorbent cotton may be placed adjacent to the conventional centrifugal fan. Consequently, the material cost of the electric apparatus may increase, and the amount of space in the electric apparatus may be decreased due to the addition of such sound-insulation boards or sound-absorbent cotton, possibly making necessary changes to the positions where elements may be located in the external case. Furthermore, there are several types of blades in use in present-day centrifugal fans. When manufacturers use a housing to accommodate different types of blades, even though this allows different types of blades to be fitted for the same housing, the level of noise is still difficult to control due to the straight formation of the peripheral edges of the struts in the conventional centrifugal fan.

SUMMARY

An aspect of the present invention is to provide a centrifugal fan.

In an embodiment of the present invention, a centrifugal fan includes a housing, a driving device, and blades. The housing includes a circular base and at least two struts. Each of the struts physically connects the circular base and the remainder of the housing, and each of the struts includes two peripheral edges. The driving device is placed on the circular base. Each of the blades has an arc shape and the blades are located in the housing. In use, the driving device rotates the blades, and the two peripheral edges of each of the struts form orthogonal curves with the blades.

Another aspect of the present invention is to provide a centrifugal fan.

In an embodiment of the present invention, a centrifugal fan includes a housing, a driving device, and blades. The housing includes a circular base and at least two struts. Each of the struts physically connects the circular base and the remainder of the housing, and each of the struts includes two peripheral edges. The driving device is placed on the circular base. Each of the blades has an arc shape and the blades are located in the housing. The driving device rotates the blades. When the blades intersect with each of the two peripheral edges of each of the struts, the angles between the blades and each of the two peripheral edges of each of the struts are orthogonal.

In an embodiment of the present invention, each of the blades is a backswept blade.

In an embodiment of the present invention, each of the orthogonal curves formed by the blades and the struts is expressed as polar coordinates $V=R\cdot e^{i\Phi}-(R-r)\cdot e^{i\theta}$, and $d\phi/d\theta=[(R-r)/R]\cdot\cos(\theta-\phi)$, where $\theta$ is an angle defined by the center of curvature of each of the blades and the center of the circular base, $\phi$ is an angle defined by the intersection point between each of the orthogonal curves and each of the blades and the center of curvature of each of the blades, r is the radius of the circular base, and R is the radius of curvature of each of the blades.

In an embodiment of the present invention, each of the peripheral edges of the struts is expressed as polar coordinates $V=R\cdot e^{i\Phi}-(R-r)\cdot e^{i\theta}$, and $d\phi/d\theta=[(R-r)/R]\cdot\cos(\theta-\phi)$, where $\theta$ is an angle defined by the center of curvature of each of the blades and the center of the circular base, $\phi$ is an angle defined by the intersection point between each of the peripheral edges of the struts and each of the blades and the center of curvature of each of the blades, r is the radius of the circular base, and R is the radius of curvature of each of the blades.

In an embodiment of the present invention, the circular base and the struts are integrally formed as a single unitary piece.

In an embodiment of the present invention, the driving device comprises a motor.

In the aforementioned embodiment of the present invention, the peripheral edges of the struts form orthogonal curves with the blades and the struts, or when the blades intersect with each of the peripheral edges of the struts, the angles between the blades and each of the peripheral edges of the struts are orthogonal. In use, the driving device rotates the blades and air is drawn into hollow regions located between the struts. However, only a small amount of the air collides with the struts mentioned above, such that the noise generated by air may be decreased. Moreover, manufacturers do not need to increase a thickness of an external case of an electric apparatus that includes the centrifugal fan or place additional sound-insulation boards or sound-absorbent cotton adjacent to the centrifugal fan in order to decrease the noise generated by airflow. Thus, the manufacturing cost of the electric apparatus utilizing the centrifugal fan may be reduced.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 2:
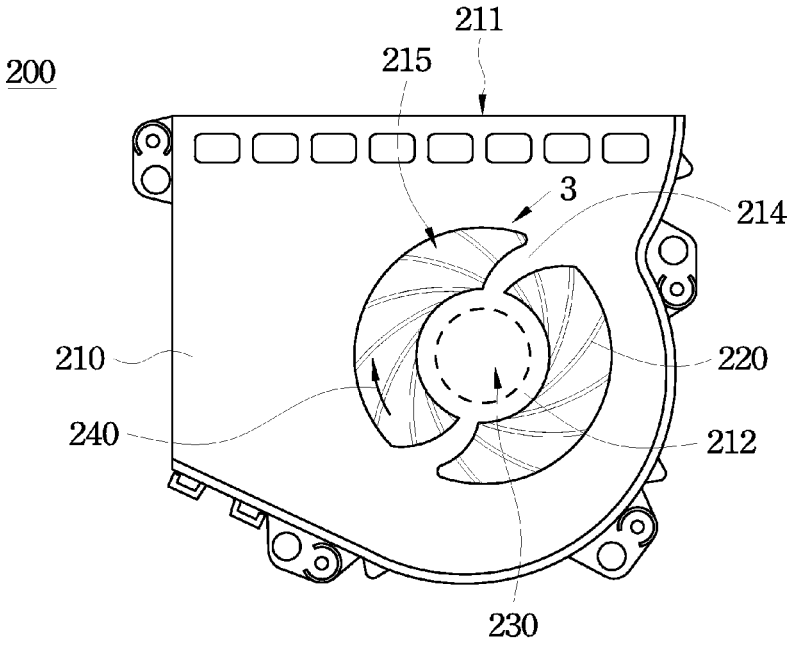
FIG. 2 is a top view of a centrifugal fan of an embodiment of the present invention.
Figure 3:
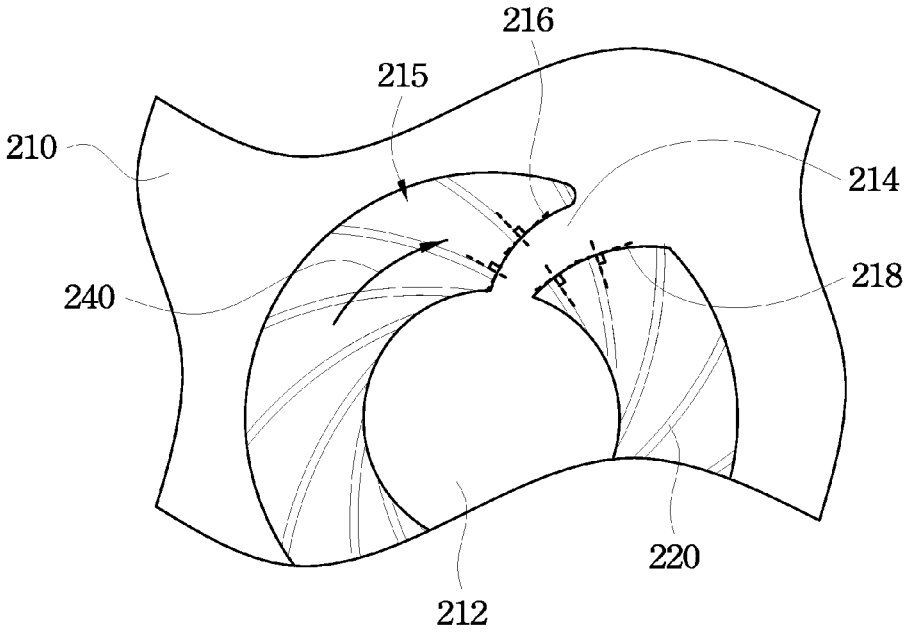
FIG. 3 is a partial enlarged view of the centrifugal fan shown in FIG. 2.

FIG. 2 is a top view of a centrifugal fan 200 of an embodiment of the present invention. FIG. 3 is a partial enlarged view of the centrifugal fan 200 shown in FIG. 2. As shown in FIG. 2 and FIG. 3, the centrifugal fan 200 includes a housing 210, a driving device 230, and blades 220. The housing 210 includes a circular base 212 and two struts 214. Two end portions of each of the struts 214 are physically connected to the circular base 212 and the remainder of the housing 210, respectively. The driving device 230 is placed on a side of the circular base 212 adjacent to the blades 220. Each of the blades 220 has an arc shape and is located in the housing 210.

Moreover, each of the struts 214 includes a first peripheral edge 216 and a second peripheral edge 218, each extending between the two end portions that are connected respectively to the housing 210 and the circular base 212. The first peripheral edge 216 and the second peripheral edge 218 of the strut 214 form orthogonal curves with the blades 220. That is, the angles formed between the rotating blades 220 and the first peripheral edge 216 of the strut 214 are orthogonal, and the angles formed between the rotating blades 220 and the second peripheral edge 218 of the strut 214 are also orthogonal.

In this embodiment, the driving device 230 may be electrically connected to an external device (not shown) so as to have power to rotate. When the driving device 230 rotates the blades 220, the blades 220 located in the housing 210 may rotate in a direction 240. As a result, air may be drawn into the housing 210 through hollow regions 215 located between the struts 214, after which the air is compressed by the rotating blades 220 and exhausted from an air outlet 211 of the housing 210.

Figure 1:
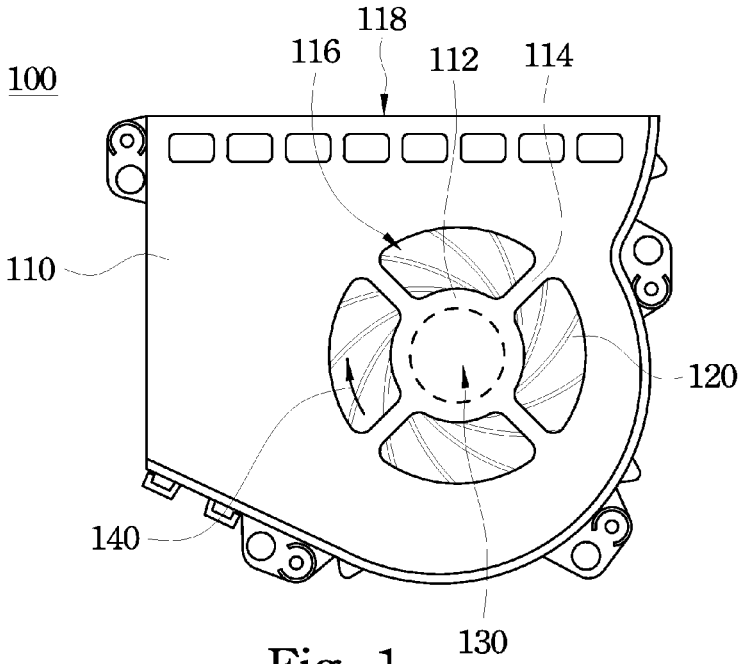
Fig. 1 (Prior Art)
FIG. 1 is a top view of a conventional centrifugal fan.

Compared with the conventional centrifugal fan 100 shown in FIG. 1, because the first peripheral edge 216 and the second peripheral edge 218 of each of the struts 214 of the centrifugal fan 200 form orthogonal curves with the blades 220, when air is drawn into the hollow regions 215 located between the struts 214 by the blades 220 of the centrifugal fan 200, only a small amount of air collides with the struts 214, such that the noise generated by air colliding with the struts 214 is decreased.

As far as an electric apparatus (not shown) utilizing the centrifugal fan 200 is concerned, manufacturers do not need to increase a thickness of an external case of the electric apparatus that includes the centrifugal fan 200 or place additional sound-insulation boards or sound-absorbent cotton adjacent to the centrifugal fan 200 in order to decrease the noise generated by air colliding with the struts 214. Thus, the manufacturing cost or material cost of the electric apparatus utilizing the centrifugal fan 200 can be reduced.

In this embodiment, the circular base 212 and the struts 214 of the housing 210 may be integrally formed as a single unitary piece by injection molding. Moreover, each of the blades 220 may be a backswept blade. The driving device 230 may include a motor. Furthermore, in other embodiments, in order to improve the rotating stability of the blades 220, the circular base 212 may be connected to more struts 214 in accordance with actual requirements.

It is to be noted that much of the information described in the above embodiments will not be repeated in the following description. The following description provides more details with respect to an embodiment including an increased number of the struts 214.

Figure 4:
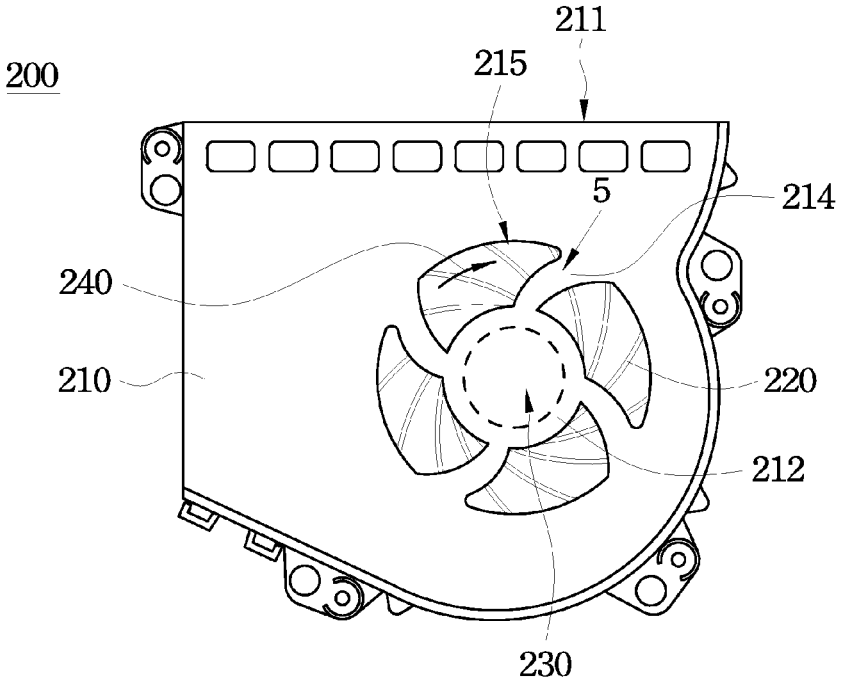
FIG. 4 is a top view of the centrifugal fan of another embodiment of the present invention.
Figure 5:
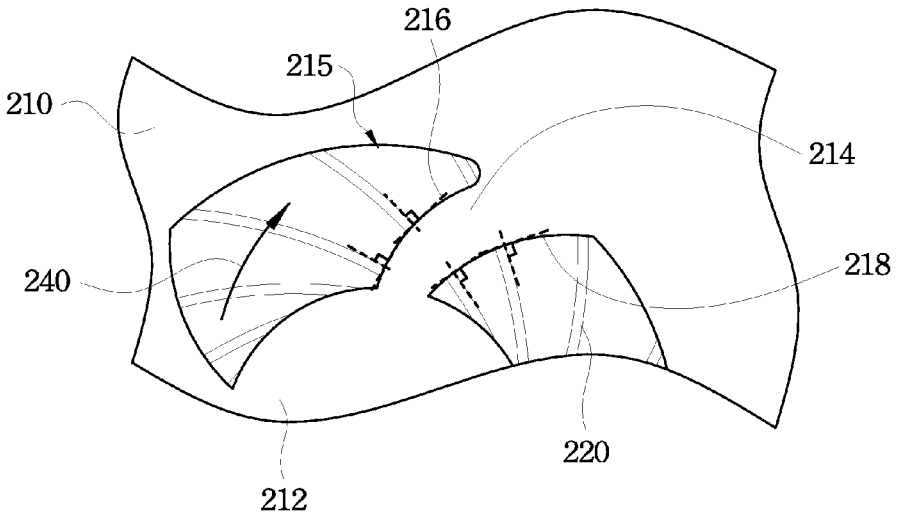
FIG. 5 is a partial enlarged view of the centrifugal fan shown in FIG. 4.

FIG. 4 is a top view of the centrifugal fan 200 of another embodiment of the present invention. FIG. 5 is a partial enlarged view of the centrifugal fan 200 shown in FIG. 4. As shown in FIG. 4 and FIG. 5, the centrifugal fan 200 includes the housing 210, the driving device 230, and the blades 220. The housing 210 includes the circular base 212. The driving device 230 is placed on a side of the circular base 212 adjacent to the blades 220. The blades 220 are located in the housing 210. However, the difference between this embodiment and the aforementioned embodiment is that the housing 210 includes four of the struts 214 physically connected to the circular base 212 at intervals.

In this embodiment, when the driving device 230 rotates the blades 220, the blades 220 located in the housing 210 may rotate in the direction 240. Because the circular base 212 is physically connected to the remainder of the housing 210 by the four struts 214, the blades 220 and the driving device 230 may rotate more stably on the circular base 212. With such a design, air is more stably drawn into the housing 210 through hollow regions 215 located between the four struts 214, and air is also more stably exhausted from the air outlet 211 of the housing 210.

Similarly, each of the struts 214 includes the first peripheral edge 216 and the second peripheral edge 218. The first peripheral edge 216 and the second peripheral edge 218 of the strut 214 form orthogonal curves with the blades 220. Consequently, even though the housing 210 of this embodiment includes the four struts 214, still only a small amount of air collides with the struts 214, such that the noise generated by air colliding with the struts 214 is not increased as a result of the increased number of the struts 214.

It is to be noted that much of the information described in the above embodiments will not be repeated in the following description. The following description provides more details with respect to the orthogonal curves formed by the blades 220 and the struts 214.

Figure 6:
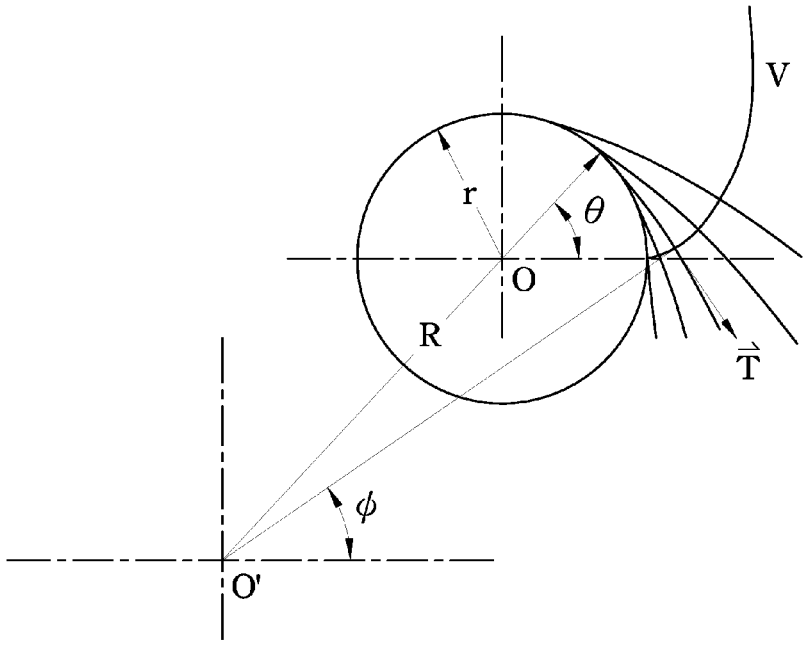
FIG. 6 is a schematic diagram for explaining an orthogonal curve of an embodiment of the present invention.

FIG. 6 is a schematic diagram for explaining an orthogonal curve of an embodiment of the present invention. As shown in FIG. 5 and FIG. 6, the first peripheral edge 216 and the second peripheral edge 218 of the strut 214 form orthogonal curves with the blades 220. Each of the orthogonal curves may be expressed as polar coordinates $V=R\cdot e^{i\Phi}-(R-r)\cdot e^{i\Theta}$, where V is an orthogonal curve, θ is an angle defined by the center of curvature O' of each of the blades 220 and the center of the circular base 212, ϕ is an angle defined by the intersection point between the orthogonal curve V and each of the blades 220 and the center of curvature O' of each of the blades 220, r is the radius of the circular base 212, and R is the radius of curvature of each of the blades 220.

Moreover, the transient track of the orthogonal curve V is orthogonal to tangent vectors $\overline{T}$ of the blades. Thus, $(dV/d\theta)\bullet\overline{T}=0$, in which $$\vec{T} = e^{-i\left(\frac{\pi}{2}-\phi\right)} = -ie^{i\phi}.$$

By substituting the equation "$V=R\cdot e^{i\Phi}-(R-r)\cdot e^{i\Theta}$" into the aforementioned equation "$(dV/d\theta)\bullet\overline{T}=0$", the equation "$d\phi/d\theta=[(R-r)/R]\cdot\cos(\theta-\phi)$" can be obtained.

By the aforementioned mathematical equations, the orthogonal curves V may be designed as the first peripheral edge 216 and the second peripheral edge 218 of the strut 214, such that when the blades 220 intersect with the struts 214, the angles between the blades 220 and the struts 214 are all orthogonal.

The centrifugal fan 200 has the following advantages and features:

(1) The peripheral edges of the struts of the centrifugal fan form orthogonal curves with the blades. Therefore, when the driving device rotates the blades, the noise generated by air colliding with the struts may be decreased.

(2) Because the peripheral edges of the struts of the centrifugal fan form orthogonal curves with the blades, when designers desire to increase the number of the struts, the noise generated by air does not increase significantly, and the circular base may be fixed more firmly by the increased number of struts. As a result, the blades may rotate more steadily in the housing.

(3) As far as manufacturing is concerned, the circular base, the struts, and the housing may be integrally formed as a single unitary piece. Thus, manufacturers only need to design the peripheral edges of the struts in a manner that forms orthogonal curves with the blades, such that the noise generated by air colliding with the struts may be decreased. For this reason, manufacturers do not need to use additional materials (e.g., sound-insulation boards or sound-absorbent cotton) to minimize the noise generated by airflow, such that the manufacturing cost of the electric apparatus utilizing the centrifugal fan may be reduced.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A centrifugal fan, comprising:

a housing, comprising:

a circular base; and at least two struts, each of the struts physically connecting the circular base and a remainder of the housing, each of the struts comprising two peripheral edges, and the peripheral edges of the struts being non-linear;

a driving device disposed on the circular base; and a plurality of blades disposed in the housing, each of the blades having an arc shape, wherein the driving device rotates the blades, the two peripheral edges of each of the struts form orthogonal curves with the blades, and the blades and the peripheral edges of the struts always form orthogonal angles.

2. The centrifugal fan as claimed in claim 1, wherein each of the blades is a backswept blade.

3. The centrifugal fan as claimed in claim 1, wherein each of the orthogonal curves formed by the blades and the struts is expressed as polar coordinates $V=R\cdot e^{i\Phi}-(R-r)\cdot e^{i\Theta}$, and $d\phi/d\theta=[(R-r)/R]\cdot\cos(\theta-\phi)$, where θ is an angle defined by the center of curvature of each of the blades and the center of the circular base, ϕ is an angle defined by the intersection point between each of the orthogonal curves and each of the blades and the center of curvature of each of the blades, r is the radius of the circular base, and R is the radius of curvature of each of the blades.

4. The centrifugal fan as claimed in claim 1, wherein the circular base and the struts are integrally formed as a single unitary piece.

5. The centrifugal fan as claimed in claim 1, wherein the driving device comprises a motor.

6. A centrifugal fan, comprising:

a housing comprising:

a circular base; and at least two struts, each of the struts physically connecting the circular base and a remainder of the housing, each of the struts comprising two peripheral edges, and the peripheral edges of the struts being non-linear;

a driving device disposed on the circular base; and a plurality of blades disposed in the housing, each of the blades having an arc shape, wherein the driving device rotates the blades, and when the blades intersect with each of the two peripheral edges of each of the struts, the blades and the peripheral edges of the struts always form orthogonal angles.

7. The centrifugal fan as claimed in claim 6, wherein each of the blades is a backswept blade.

8. The centrifugal fan as claimed in claim 6, wherein each of the peripheral edges of the struts is expressed as polar coordinates $V=R\cdot e^{i\Phi}-(R-r)\cdot e^{i\Theta}$, and $d\phi/d\theta=[(R-r)/R]\cdot\cos(\theta-\phi)$, where θ is an angle defined by the center of curvature of each of the blades and the center of the circular base, ϕ is an angle defined by the intersection point between each of the peripheral edges of the struts and each of the blades and the center of curvature of each of the blades, r is the radius of the circular base, and R is the radius of curvature of each of the blades.

9. The centrifugal fan as claimed in claim 6, wherein the circular base and the struts are integrally formed as a single unitary piece.

10. The centrifugal fan as claimed in claim 6, wherein the driving device comprises a motor.

* * * * *